US008764473B2

(12) United States Patent
Komatsubara

(10) Patent No.: US 8,764,473 B2
(45) Date of Patent: Jul. 1, 2014

(54) BALL-LOCK CONNECTOR

(75) Inventor: Manabu Komatsubara, Yokohama (JP)

(73) Assignee: Canare Electric Co., Ltd., Nisshin-Shi (JP)

( * ) Notice: Subject to any disclaimer, the term of this patent is extended or adjusted under 35 U.S.C. 154(b) by 63 days.

(21) Appl. No.: 13/642,418

(22) PCT Filed: Apr. 22, 2011

(86) PCT No.: PCT/JP2011/059927

§ 371 (c)(1),
(2), (4) Date: Oct. 19, 2012

(87) PCT Pub. No.: WO2011/132772

PCT Pub. Date: Oct. 27, 2011

(65) Prior Publication Data

US 2013/0052855 A1 Feb. 28, 2013

(30) Foreign Application Priority Data

Apr. 22, 2010 (JP) ..... 2010-099073

(51) Int. Cl.
*H01R 13/625* (2006.01)

(52) U.S. Cl.
USPC ..... 439/348

(58) Field of Classification Search
USPC ..... 439/348, 578, 584, 583, 319, 347, 439/350–358
See application file for complete search history.

(56) References Cited

U.S. PATENT DOCUMENTS 3,684,321 A * 8/1972 Hundhausen et al. ..... 285/316
5,690,503 A 11/1997 Konda et al.
6,824,415 B2 * 11/2004 Wlos ..... 439/348
7,201,608 B2 * 4/2007 Rosenberger et al. ..... 439/578
8,435,061 B2 * 5/2013 Ijima ..... 439/348
8,506,325 B2 * 8/2013 Malloy et al. ..... 439/578

FOREIGN PATENT DOCUMENTS

JP 53-20586 A 2/1978
JP 3-128295 U 12/1991
JP 5-266947 A 10/1993
JP 9-92395 A 4/1997

* cited by examiner

*Primary Examiner* — Jean F Duverne
(74) *Attorney, Agent, or Firm* — Birch, Stewart, Kolasch & Birch, LLP

(57) ABSTRACT

Provided is a ball-lock connector wherein a connector which has a relatively small diameter and which can be smoothly attached or detached, is realized at low cost. Ball storage holes (23) are formed in a tubular member (20), and engagement balls (11) are contained in the ball storage holes (23). An inner sleeve (30) and an outer sleeve (40) are disposed on the outside of the tubular member (20) so as to move in the axial direction. When a counterpart connector (70) is attached, each engagement ball (11) moves from a first position wherein a part of the engagement ball is projected from the inner peripheral surface (21) of the tubular member (20) to a second position which is close to a first inner peripheral surface (42) of an outer sleeve (40), wherein a part of the engagement ball is not projected from the inner peripheral surface (21), and thereafter, returns to the first position. When the counterpart connector (70) is detached, each engagement ball (11) moves from the first position to a third position which is close to a second inner peripheral surface (44) of the outer sleeve (40), wherein a part of the engagement ball is not projected from the inner peripheral surface (21), and thereafter, returns to the first position.

3 Claims, 8 Drawing Sheets

10 CONNECTOR (PLUG)
11 ENGAGEMENT BALL
20 TUBULAR MEMBER
23 BALL STORAGE HOLE
30 INNER SLEEVE
32 SMALL-DIAMETER OUTER PERIPHERAL SURFACE (FIRST OUTER PERIPHERAL SURFACE)
33 LARGE-DIAMETER OUTER PERIPHERAL SURFACE (SECOND OUTER PERIPHERAL SURFACE)
40 OUTER SLEEVE
41 INWARD PROTRUDED PART
42 SMALL-DIAMETER INNER PERIPHERAL SURFACE (FIRST INNER PERIPHERAL SURFACE)
43 LARGE-DIAMETER INNER PERIPHERAL SURFACE (THIRD INNER PERIPHERAL SURFACE)
44 SMALL-DIAMETER INNER PERIPHERAL SURFACE (SECOND INNER PERIPHERAL SURFACE)
70 COUNTERPART CONNECTOR (RECEPTACLE)
71 TUBULAR MEMBER

FIG. 1

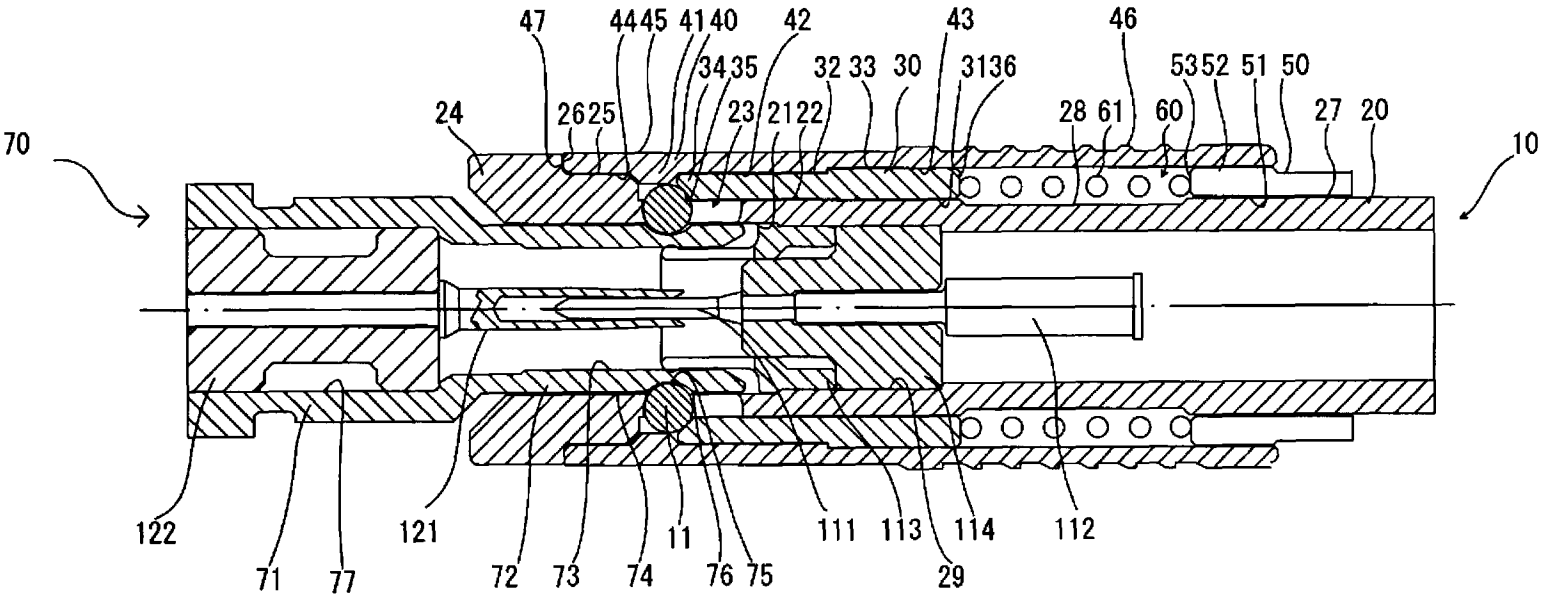

10 CONNECTOR (PLUG)
11 ENGAGEMENT BALL
20 TUBULAR MEMBER
23 BALL STORAGE HOLE
30 INNER SLEEVE
32 SMALL-DIAMETER OUTER PERIPHERAL SURFACE (FIRST OUTER PERIPHERAL SURFACE)
33 LARGE-DIAMETER OUTER PERIPHERAL SURFACE (SECOND OUTER PERIPHERAL SURFACE)
40 OUTER SLEEVE
41 INWARD PROTRUDED PART
42 SMALL-DIAMETER INNER PERIPHERAL SURFACE (FIRST INNER PERIPHERAL SURFACE)
43 LARGE-DIAMETER INNER PERIPHERAL SURFACE (THIRD INNER PERIPHERAL SURFACE)
44 SMALL-DIAMETER INNER PERIPHERAL SURFACE (SECOND INNER PERIPHERAL SURFACE)
70 COUNTERPART CONNECTOR (RECEPTACLE)
71 TUBULAR MEMBER

BALL-LOCK CONNECTOR

TECHNICAL FIELD

The present invention relates to a connector, and more particularly relates to a ball-lock connector that can be readily attached to and detached from a counterpart connector.

BACKGROUND ART

A ball-lock connector of the type that a connector and a counterpart connector are locked into a connected state is already known (for example, Patent Document 1 which will be described below (Japanese Patent Application Laid-Open No. Hei9-92395).

The conventional connector which is disclosed in Patent Document 1 is configured by comprising a ball support hole which is formed in a cylindrical fitting part disposed in a connector housing so as to open to both of its inner and outer peripheral surfaces, a lock ball which is housed in the ball support hole such that it can radially displace and cannot slip off to the side of a peripheral surface corresponding to a counterpart connector and locks the connectors together into a fitted state by bringing a part which is protruded toward the peripheral surface of the cylindrical fitting part into engagement with the counterpart connector, an elastic engaging member which is radially elastic-displaceable between an engagement position where it abuts against the lock ball which is in a state that it is engageable with the counterpart connector from the side opposite to the counterpart connector, and a retraction position where detachment of the lock ball from the counterpart connector is allowed, and a deflection restraining member that can restrain elastic deflection of the elastic engaging member to the retraction position.

In the connector disclosed in Patent Document 1, a cylindrical locking operation member is fitted on an outer periphery of the cylindrical fitting part so as to be axially movable. Then a plurality of pieces of elastic engaging members are formed integrally with this locking operation member so as to protrude forward from positions corresponding to the plurality of ball support holes in its front end edge.

PRIOR ART DOCUMENT

Patent Document

Patent Document 1: Japanese Patent Application Laid-Open No. Hei9-92395

SUMMARY OF THE INVENTION

Problem to be Solved by the Invention

The connector disclosed in Patent Document 1 is configured such that when the elastic engaging member is situated at the engagement position, the elastic engaging member whose displacement to the outer periphery side is restrained by a restraint part of the deflection restraining member presses the lock ball from the outer periphery side. In addition, the connector is also configured such that when the elastic engaging member is at the retraction position, it is elastically displaced to the outer periphery side by a permission part of the deflection restraining member to retract the lock ball into the ball support hole. Therefore, there is such a problem that the size of the connector in the radial direction is comparatively increased due to such a structure that the elastic engaging member for pressing the ball from the outer periphery side is interposed between the deflection restraining member and the lock ball.

In addition, in the connector disclosed in Patent Document 1, an elastic engaging member of a specific shape that would allow back and forth movement and radial displacement of the elastic engaging member between the engagement position and retraction position with no problem must be specifically designed. Further, in general, a special manufacturing process for forming the elastic engaging member of the specific shape integrally with the locking operation member becomes necessary. In addition, it is necessary to carefully select the material thereof, to design the structure thereof and to design the strength thereof such that the elastic engaging member that protrudes forward from the front end edge of the locking operation member is not be readily broken and deformed due to repetitive attaching and detaching operations of the connector. Therefore, it is difficult to realize a cheap connector by the prior art that Patent Document 1 discloses.

Therefore, an object of the present invention is to provide a novel connector that solves the above mentioned problems of the prior art thereby to cheaply realize the connector that has the size which is comparatively narrowed in diameter, and can be smoothly attached and detached.

Means for Solving the Problems

In order to solve the above mentioned problems, the connector according to the present invention is characterized in that in the connector which is detachably connected to a counterpart connector, the connector comprises: a tubular member, in which at least one ball storage hole that axially elongates, passing through it from its outer peripheral surface to its inner peripheral surface is formed; an inner sleeve which is disposed on the outer peripheral surface of said tubular member so as to be axially movable; an outer sleeve which is disposed on the outside of said inner sleeve so as to be axially movable, the outer sleeve having a protruded part disposed between a first inner peripheral surface and a second peripheral surface; and an engagement ball which is housed in the ball storage hole in said tubular member so as to be axially and radially movable, the engagement ball moving from a first position where at least a part of the engagement ball protrudes inward from the inner peripheral surface of the tubular member by being depressed by the protruded part of the outer sleeve and which is closer to one axially-directed end surface of the ball storage hole, and back to the first position via a second position where a part of the engagement ball does not protrude inward from the inner peripheral surface of the tubular member in the vicinity of the first inner peripheral surface of the outer sleeve and which is closer to the other axially-directed end surface of the ball storage hole when the counterpart connector is to be attached, and moving from the first position and back to the first position via a third position where a part of the engagement ball does not protrude inward from the inner peripheral surface of the tubular member in the vicinity of the second inner peripheral surface of the outer sleeve and which is closer to one axially-directed end surface of the ball storage hole when the counterpart connector is to be detached, wherein when the counterpart connector is attached and connected to the connector, the part of the engagement ball situated at the first position protrudes inward from the inner peripheral surface of the tubular member into engagement with an engagement recessed part which is formed in an outer peripheral surface of the counterpart connector, and the engagement ball is held on the side of one axially-directed end of the ball storage hole by a pressing force from the inner sleeve.

In a preferred embodiment of the connector according to the present invention, the connector may be configured such that said inner sleeve has a leading end side inclined surface that comes into contact with the engagement ball when the counterpart connector is attached, and a trailing end surface that receives a pressing force from a compression spring which is disposed on the outer peripheral surface of the tubular member.

In a preferred embodiment of the connector according to the present invention, the connector may be configured such that said inner sleeve has a first small-diameter outer peripheral surface situated on the leading end side, and a second large-diameter outer peripheral surface situated on the trailing end side, and said outer sleeve further has a third large-diameter inner peripheral surface which is adjacent to the first small-diameter inner peripheral surface of the outer sleeve, the first small-diameter outer peripheral surface and the second large-diameter outer peripheral surface of the inner sleeve respectively correspond to the first small-diameter inner peripheral surface and the second large-diameter inner peripheral surface of the outer sleeve, and when an insert cylinder part of the counterpart connector is attached to the tubular member, the inner sleeve moves in a direction in which the compression spring is compressed relative to the tubular member and the outer sleeve, and when the insert cylinder part of the counterpart connector is detached from the tubular member, the outer sleeve and the inner sleeve move together in the direction in which the compression spring is compressed relative to the tubular member.

Effect of the Invention

Since the connector according to the present invention can provide a desired ball locking mechanism with the counterpart connector by basically combining the tubular member in which at least one ball storage hole is formed, with the inner sleeve and the outer sleeve which are disposed on the outside of the tubular member to be axially movable and are not complicated in shape comparatively, there can be realized the connector which has the size which is narrower in diameter than the prior art and can be smoothly attached and detached. In addition, since these tubular member and inner and outer sleeves require no complicated manufacturing process, the connector can be cheaply realized.

In the preferred embodiment of the present invention, when it is configured such that the inner sleeve has the leading end side inclined surface which is in contact with the engagement ball when the counterpart connector is attached, and the rear end surface that receives the pressing force from the compression spring which is disposed on the outer peripheral surface of the tubular member, it becomes possible to surely move the engagement ball from the first position and again back to the first position via the second position within the connector in accordance with the operation of relatively moving it toward the counterpart connector in a state that the outer peripheral surface of the outer sleeve of the connector is gripped with fingertips, thereby to ensure an operation of stably attaching the connectors to each other. In addition, when the engagement ball reaches the first position (that is, when it engages with the engagement recessed part of the counterpart connector to establish the mutually locked state of the connectors), the engagement ball is surely held at that position, so that the connector does not readily slip off from the counterpart connector even when the tubular member of the connector is strongly pulled in a detaching direction.

In the preferred embodiment of the present invention, when it is configured such that the inner sleeve has the first small-diameter outer peripheral surface which is positioned on the leading end side and the second large-diameter outer peripheral surface which is positioned on the trailing end side, the outer sleeve further has the third large-diameter inner peripheral surface which is adjacent to the first small-diameter inner peripheral surface of the outer sleeve, the first small-diameter outer peripheral surface and the second large-diameter outer peripheral surface of the inner sleeve respectively correspond to the first small-diameter inner peripheral surface and the second large-diameter inner peripheral surface of the outer sleeve, when the insert cylinder part of the counterpart connector is attached to the tubular member, the inner sleeve moves in the direction in which the compression spring is compressed relative to the tubular member and the outer sleeve, and when the insert cylinder part of the counterpart connector is detached from the tubular member, the outer sleeve and the inner sleeve move together in the direction in which the compression spring is compressed relative to the tubular member, it becomes possible to surely move the engagement ball from the first position to the third position within the connector in accordance with the operation of relatively moving it away from the counterpart connector in the state that the outer peripheral surface of the outer sleeve of the connector is gripped with the fingertips, thereby to ensure an operation of stably detaching the connectors from each other.

The above mentioned object and advantages and other objects and advantages of the present invention will be more clearly understood from the following description of preferred embodiments. However, the embodiments which will be described below are merely illustrative and the present invention is not limited thereto.

BRIEF DESCRIPTION OF THE DRAWINGS

FIG. 1 is a sectional diagram of an example of a connector according to the present invention when it is in a state that it is connected with a counterpart connector.

MODES FOR CARRYING OUT THE INVENTION

Hereinafter, preferred embodiments of the connector according to present invention will be described in detail on the basis of the drawings.

Figure 2:
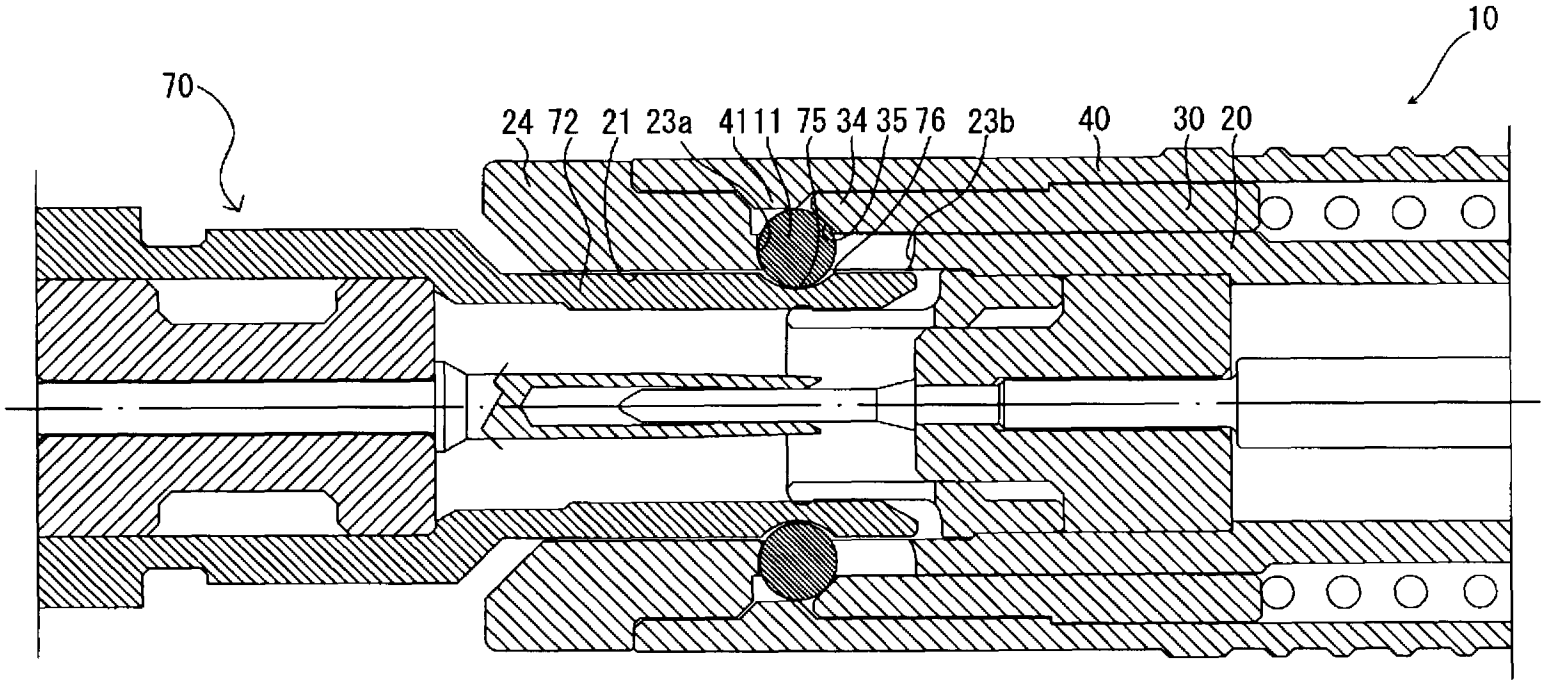
FIG. 2 is a partially enlarged sectional diagram when it is in the state that it is connected with the counterpart connector.
Figure 3:
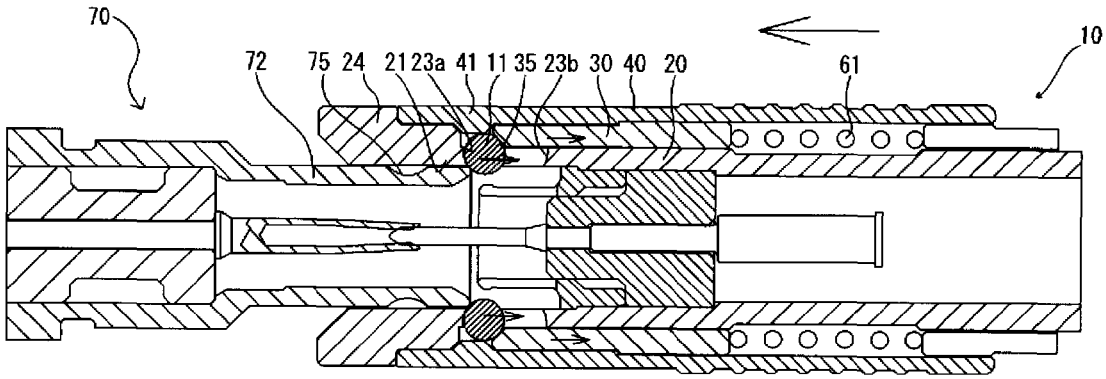
FIG. 3 is a sectional diagram of a first state in an attaching operation.
Figure 4:
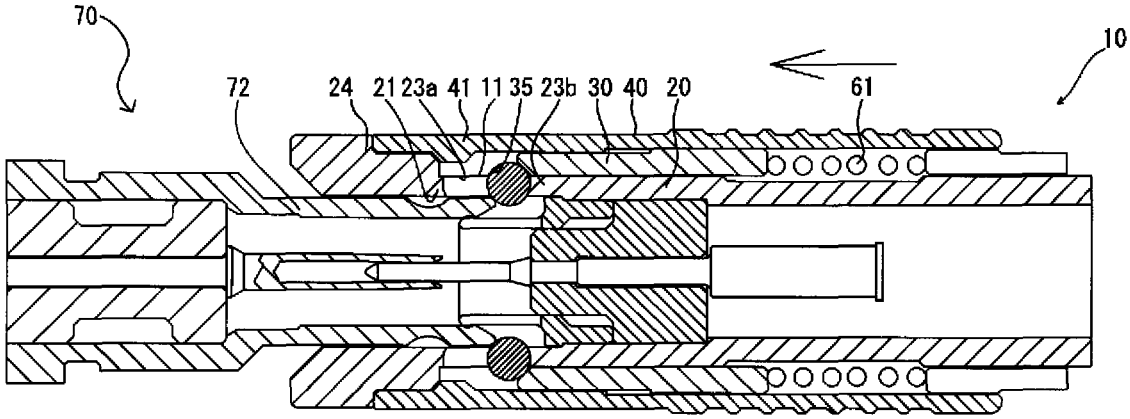
FIG. 4 is a sectional diagram of a second state in the attaching operation.
Figure 5:
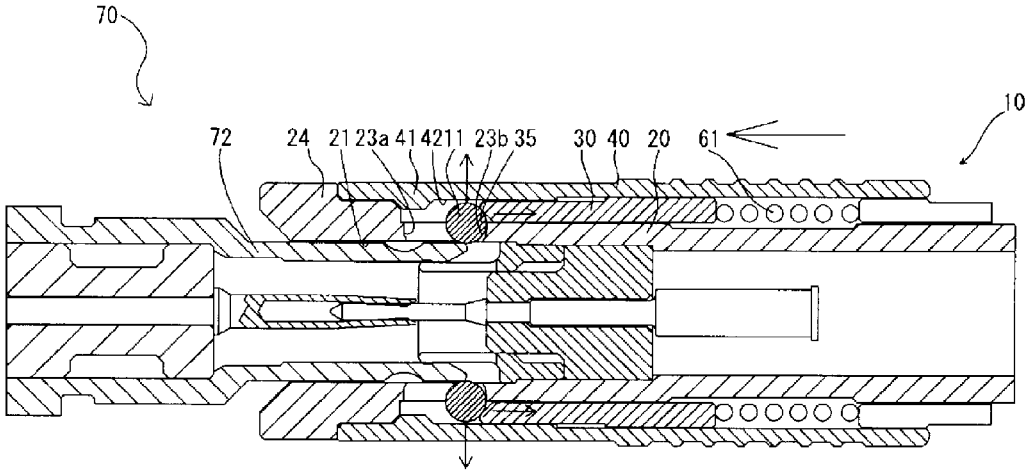
FIG. 5 is a sectional diagram of a third state in the attaching operation.
Figure 6:
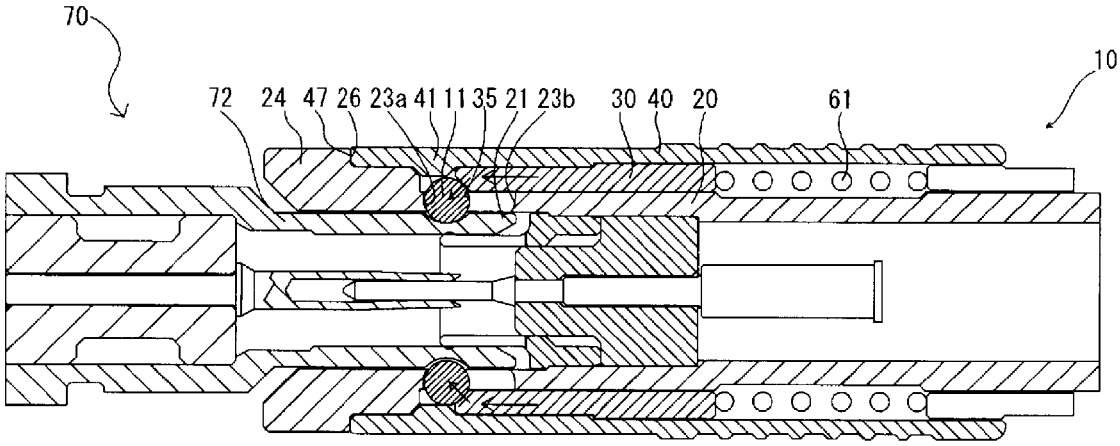
FIG. 6 is a sectional diagram of a fourth state in the attaching operation.
Figure 7:
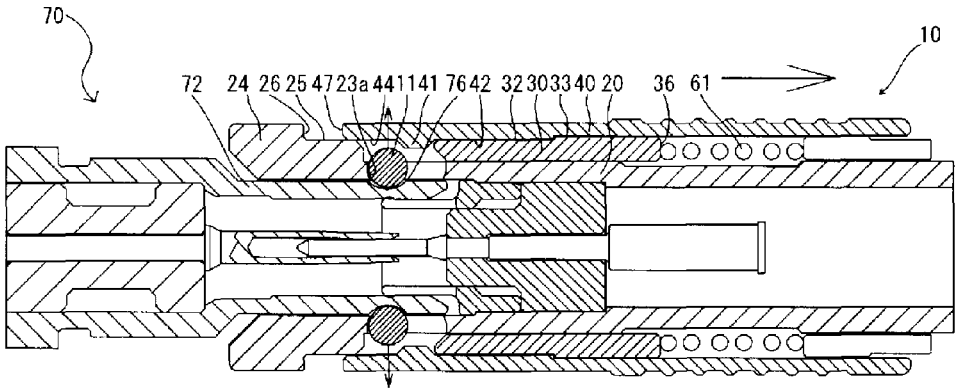
FIG. 7 is sectional diagram of a first state in a detaching operation.
Figure 8:
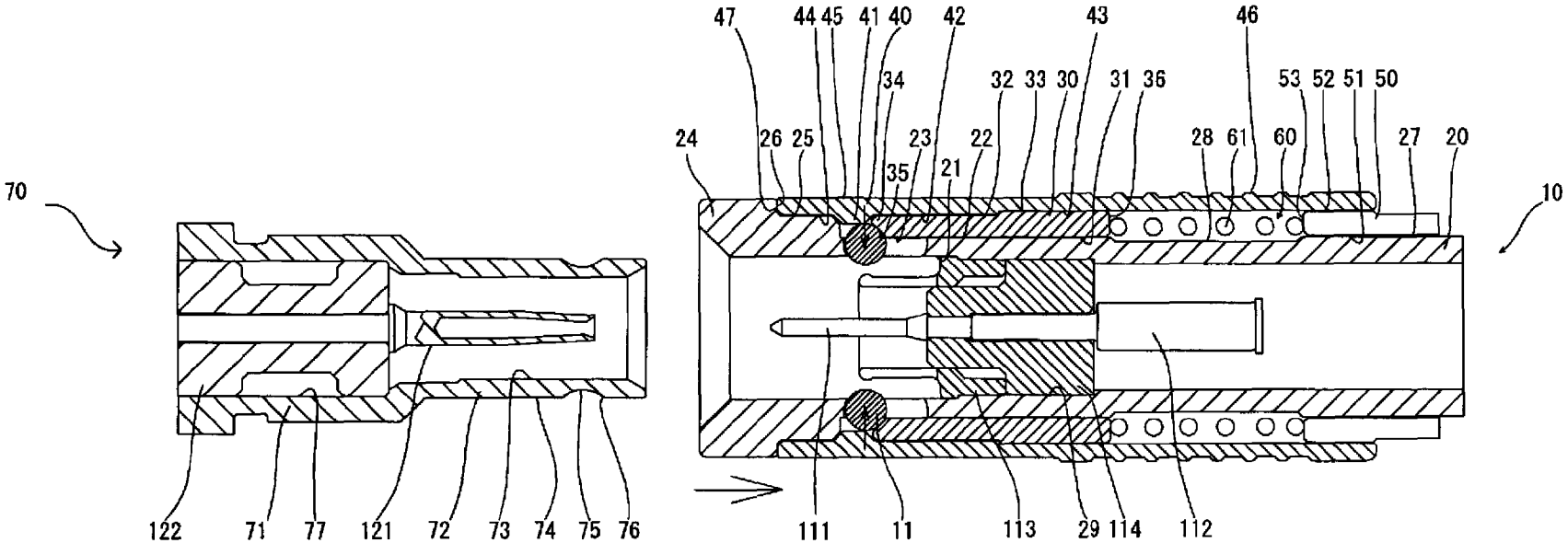
FIG. 8 is sectional diagram of a second state in the detaching operation.

FIG. 1 is a sectional diagram of an example of a connector to which the present invention is applied, in a state that it is connected with a counterpart connector. FIG. 2 is a partially enlarged sectional diagram when it is in the state that it is connected with the counterpart connector. FIG. 3 is a sectional diagram of a first state in an attaching operation. FIG. 4 is a sectional diagram of a second state in the attaching operation. FIG. 5 is a sectional diagram of a third state in the attaching operation. FIG. 6 is a sectional diagram of a fourth state in the attaching operation. FIG. 7 is sectional diagram of a first state in a detaching operation. FIG. 8 is sectional diagram of a second state in the detaching operation.

The connector according to the present embodiment which will be described below is an example in which the present invention is applied to a plug configured by a tubular member that has a center contact and a male contact built-in. Thus, although a receptacle configured by a tubular member that has a female contact built-in is suitable as a counterpart connector to be detachably connected with that connector, an electric plug which can be attached to and detached from the receptacle is merely one example and the present invention is not limited to this.

With reference to FIG. 1, a connector 10 has a tubular member 20, an inner sleeve 30, and an outer sleeve 40. The tubular member 20 has an inner peripheral surface 21 and a first outer peripheral surface 22, and three ball storage holes 23 that axially elongate passing through it from the first outer peripheral surface 22 to the inner peripheral surface 21 are formed circumferentially at equal intervals (at intervals of) 120°) (therefore, it is to be noted that the sectional diagram in FIG. 1 is not the sectional diagram of one plane that passes through the central axis of the connector 10, and it corresponds to a diagram in which sectional diagrams of two planes that pass its central axis and intersect with each other at an angle of 120° are developed. In the following, the same also applies to the sectional diagrams in FIG. 2 to FIG. 8). A receive cylinder part 24 on the outer periphery side of which a second outer peripheral surface 25 and a block wall 26 are formed is disposed on the leading end side of the tubular member 20. The tubular member 20 has a threaded surface 27 in which a thread groove is formed, the first outer peripheral surface 22, and a third outer peripheral surface 28 formed between the first outer peripheral surface 22 and the threaded surface 27 on its trailing end side outer periphery. Further, the tubular member 20 has a male contact 112 having a center contact on the leading end side, and an outer contact 113 within the tubular member 20. The male contact 112 axially passes through the center of an insulation spacer 114, and an outer peripheral surface of the insulation spacer 114 fits a contact support surface 29 of the tubular member 20 to support the male contact 112 so as to electrically insulate it from the tubular member 20, and the outer contact 113 that fits the contact support surface 29 of the tubular member 20.

The engagement ball 11 is housed in the ball storage hole 23. The width of a radially-directed opening in the ball storage hole 23 is smaller than the diameter of the engagement ball 11 in the inner peripheral surface 27 of the tubular member 20, and is almost the same as or slightly larger than the diameter of the engagement ball 11 in the first outer peripheral surface 22. Thus, when the engagement ball 11 is in a state that it is radially depressed inward within the ball storage hole 23, a part of the engagement ball 17 protrudes inward from the inner peripheral surface 21 of the tubular member 20. Although the axially-directed length of the ball storage hole 23 is naturally larger than the diameter of the engagement ball, that length can be appropriately determined in consideration of the longitudinal width of an inward protruded part 41 formed on the later described outer sleeve 40.

The engagement ball 11 which is housed in the ball storage hole 23 axially and radially moves in the ball storage hole 23 with axial movement of the inner sleeve 30, or both of the inner sleeve 30 and the outer sleeve 40 in accordance with an operation of attaching or an operation of detaching a later described counterpart connector 70. Details of the movement of the engagement ball 11 mentioned above will be described later.

The inner sleeve 30 has an inner peripheral surface 31, and a small-diameter outer peripheral surface 32 and a large-diameter outer peripheral surface 33 which are adjacent to each other. Incidentally, the small-diameter outer peripheral surface 32 is made different from the large-diameter outer peripheral surface 33 in outer diameter for the purpose of letting the inner sleeve 30 have a stepped outer peripheral surface (when the outer sleeve 40 axially slides backward relative to the inner sleeve 30, this step engages with a step that an inner peripheral surface of the outer sleeve 40 has, and when it slides in an opposite direction, this engagement is released as will be described later). Thus, it is not necessary to increase a difference between outer diameters more than needed. The inner sleeve 30 has an inclined surface 35 which is inward inclined on its leading end part 34 and has a trailing end surface 36 on the side opposite to the leading end part 34.

The outer sleeve 40 has the inward protruded part 41, a small-diameter inner peripheral surface 42 (corresponding to a "first small-diameter inner peripheral surface") which is positioned on the trailing end side with the inward protruded part 41 behind it, a small-diameter inner peripheral surface 44 (corresponding to a "second inner peripheral surface") which is positioned on the leading end side with the inward protruded part 41 behind it, and a large-diameter inner peripheral surface 43 (corresponding to a "third large-diameter inner peripheral surface") which is adjacent to the small-diameter inner peripheral surface 42, and an outer peripheral surface 45. The outer sleeve 40 is formed to have a stepped inner peripheral surface owing to provision of the mutually adjacent small-diameter inner peripheral surface 42 and large-diameter inner peripheral surface 43. This step faces a step formed by the small-diameter outer peripheral surface 32 and the large-diameter outer peripheral surface 33 that the outer peripheral surface of the inner sleeve 30 has. Grip machining 46 that aids a user to firmly grip it with his fingertips or to operate it by applying a dedicated jig is disposed on the outer peripheral surface 45 on the trailing end side of the outer sleeve 40. In addition, an annular fixing member 50 is disposed between the large-diameter inner diameter surface 43 of the outer sleeve 40 and the threaded surface 27 of the tubular member 20 on the trailing end side of the outer sleeve 40. The fixing member 50 is fixed to the tubular member 20 by bringing a threaded surface 51 on the inner peripheral surface side of the fixing member 50 into engagement with the threaded surface 27 of the tubular member 20. On the other hand, an outer peripheral surface 52 of the fixing member 50 so fixed faces the large-diameter inner-diameter surface 43 of the outer sleeve 40. A compression spring 61 is housed in a gap 60 between the large-diameter inner-diameter surface 43 of the outer sleeve 40 and the third outer peripheral surface 28 of the tubular member 20 in a compressed state. A trailing end of the compression spring 61 faces a support surface 53 of the fixing member 50, and a leading end of the compression spring 61 faces the trailing end surface 36 of the inner sleeve 30. Therefore, the compression spring 46 exerts a forward elastic force directly on the inner sleeve 30 which is disposed on the outer peripheral surface of the tubular member 20 and indirectly on the outer sleeve 40 which is disposed on the outside of the inner sleeve 30 and is engaged with the inner sleeve 30 by the above steps via the inner sleeve 30 along the axial direction. Incidentally, a leading end surface 47 on the leading end side of the outer sleeve 40 is in contact with and faces the block wall 26 disposed on the outer periphery side of the receive cylinder part 24 of the tubular member 20.

Although the counterpart connector 70 is a receptacle in the present embodiment, there is no particular difference between it and a conventional structure. That is, a tubular member 71 has an insert cylinder part 72 that has an outer-diameter size and a length sufficient to make it fit the receive cylinder part 24 of the connector 10 and extends to the leading end side. The tubular member 71 has a female contact 121 within it. The female contact 121 axially passes through the center of an insulation spacer 122, and an outer peripheral surface of that insulation spacer 122 fits a contact support surface 77 of the tubular member 71, thereby to support the female contact 121 so as to electrically insulate it from the tubular member 71. It is designed such that when the counterpart connector 70 is attached to the connector 10, a hollow part of the female contact 121 receives the center contact 111 that the connector 10 has and fits it, and an inner peripheral surface 73 of the insert cylinder part 72 fits an outer peripheral surface of the outer contact 113 that the connector 10 has.

On the other hand, an engagement recessed part 75 is formed in an outer peripheral surface 74 of the insert cylinder part 72 of the counterpart connector 70. Although the engagement recessed part 75 is, for example, a shallow U-shaped groove which is annularly formed in the outer peripheral surface 74, it is not limited to this. When the engagement ball 11 which is built in the connector 10 is situated at a position (a later described "first position") as illustrated in large size in FIG. 2, a part of the engagement ball 11 which is housed in the ball storage hole 23 protrudes inward from the inner peripheral surface 21 of the tubular member 20 of the connector 10 and engages with the engagement recessed part 75 of the counterpart connector 70. Locked connection between the counterpart connector 70 and the connector 10 is established by this engagement. An enlarged section when the counterpart connector 70 is attached to the connector 10 and the both are in a connected relation is shown in FIG. 2. In FIGS. 2, 23*a* and 23*b* respectively denote a forward end of the ball storage hole 23 and a backward end of the ball storage hole 23. When the counterpart connector 70 is attached to the connector 10 and the both are in the connected relation (and, as described later, when the counterpart connector 70 is detached from the connector 10 and the both are in a separated relation, or when the leading end part of the insert cylinder part 72 of the counterpart connector 70 is in a state that it does not reach the ball storage hole 23), the engagement ball 11 is pushed by the inclined surface 35 of the inner sleeve 30 in an obliquely forward and inward direction and is pushed inward by the inward protruded part 41 of the outer sleeve 40, by which it faces the forward end 23*a* of the ball storage hole 23. This position of the engagement ball 11 will be sometimes called the "first position" hereinafter.

Next, an operation of the connector according to the present embodiment will be described with reference to FIG. 3 and succeeding drawings. Here, an example in which the user grips the outer sleeve 40 of the connector 10 which is the plug with his fingertips or applies the dedicated jig to the outer sleeve 40 to perform an operation of attaching it to the counterpart connector 70 which is the receptacle, and an example in which an operation of detaching it from the counterpart connector 70 is performed will be described.

First, the example in which the operation of attaching the connector 10 according to the present embodiment to the counterpart connector 70 is performed will be described with reference to FIG. 3 to FIG. 6. In FIG. 3 showing a state that the connector 10 is inserted into the counterpart connector 70, when a leading end part of the insert cylinder part 72 of the counterpart connector 70 which is pushed into the receive cylinder part 24 of the connector 10 reaches the engagement ball 11 that protrudes into the ball storage hole 23 in the connector 10, the leading end part of the insert cylinder part 72 begins to push the engagement ball 11 which is at the first position axially toward the rear of the tubular member 20 against the elastic force of the compression spring 61 which is transferred via the inner sleeve 30. As the leading end part of the insert cylinder 72 is pushed into the receive cylinder part 24, the engagement ball 11 axially moves within the ball storage hole 23 toward the backward end 23*b* of the ball storage hole 23. Then the engagement ball 11 reaches a position where it faces the backward end 23*b* of the ball storage hole 23 as shown in FIG. 4. Incidentally, when the engagement ball 11 is situated at this position, the inner sleeve 30 axially moves back by a distance corresponding to the axially-directed length of the ball storage hole 23. The small-diameter inner peripheral surface 42 of the outer sleeve 40 that has been hiding so far, facing the small-diameter outer peripheral surface 32 of the inner sleeve 30, appears between the leading end part 34 of the inner sleeve 30 and the inward protruded part 41 of the outer sleeve 40 in association with backward movement of the inner sleeve 30, by which a space sufficient for the engagement ball 11 to radially move outward is ensured.

When the leading end part of the insert cylinder part 72 is further pushed into the receive cylinder part 24, axially backward movement of the engagement ball 11 which is situated at the position shown in FIG. 4 is blocked by the backward end 23*b* of the ball storage hole 23 as shown in FIG. 5, and on the other hand, it radially moves outward within the ball storage hole 23 while pushing the inclined surface 35 of the inner sleeve 30 to further axially move the inner sleeve 30 backward. This position of the engagement ball 11 will be sometimes called a "second position" hereinafter. Incidentally, when the engagement ball 11 is situated at the second position, the part of the engagement ball 11 does not anymore protrude inward from the inner peripheral surface 21 of the tubular member 20. Although the space is ensured when the small-diameter inner peripheral surface 42 appears between the leading end part 34 of the inner sleeve 30 and the inward protruded part 41 of the outer sleeve 40 as described above, this is because the radially-directed width of this space (the width from the inner peripheral surface 21 of the tubular member 20, that is, the outer peripheral surface 74 of the insert cylinder part 72 to the small-diameter inner peripheral surface 42 of the outer sleeve 30) is designed to be slightly larger than the diameter of the engagement ball 11 in the present embodiment.

When the engagement ball 11 is situated at the second position shown in FIG. 5, the part of the engagement ball 11 is in a state that it does not protrude inward from the inner peripheral surface 21 of the tubular member 20, so that the elastic force of the compression spring 60 acts on the engagement ball 11 as the pressing force of the inclined surface 35 thereof via the inner sleeve 30, by which the engagement ball 11 is axially pushed back forward (toward the leading end side). Then, when the leading end part of the insert cylinder part 72 is further pushed into the receive cylinder part 24, the engagement ball 11 moves toward the forward end 23*a* of the ball storage hole 23 within the ball storage hole 20 and on the outer peripheral surface 21 of the leading end part of the insert cylinder part 72 toward the axially-directed front of the tubular member 20. Then, when the leading end part of the insert cylinder part 72 is pushed into it to a state that the engagement recessed part 75 in the insert cylinder part 72 wholly appears on the forward end 23*a* side of the ball storage hole 23, the pressing force from the inclined surface 35 of the inner sleeve 30 acts on the engagement ball 11 and the engagement ball 11 obliquely moves inward. Then, the engagement ball 11 engages with the engagement recessed part 75 in the insert cylinder part 72 at a position where it faces the forward end 23*a* of the ball storage hole 23. At that time, the engagement ball 11 is hold on the forward end 23*a* side of the ball storage hole 23 by the pressing force from the inclined surface 35 of the inner sleeve 30.

Although the position of the engagement ball 1 shown in FIG. 6 is the same as the "first position" shown in FIG. 3 with respect to the connector 10, the engagement ball 11 engages with the engagement recessed part 75 formed in the insert cylinder part 72 of the counterpart connector 70, particularly in FIG. 6. In a connected state of the counter 10 with the counterpart connector 70 shown in FIG. 6, the engagement ball 11 which is situated at the first position is radially depressed inward by the inward protruded part 41 of the outer sleeve 40, is pressed against the forward end 23*a* side of the ball storage hole 23 by the inclined surface 35 of the inner sleeve 30, and hence it cannot move radially and axially within the ball storage hole 23, by which engagement of the engagement ball 11 with the engagement recessed part 75 in the insert cylinder part 72 is locked.

When the operation of attaching the connector 10 to the counterpart connector 70 is completed in the above mentioned manner, such a desired locking mechanism is realized that lock is not released and the connected relation between the both connectors is maintained even when the tubular member 20 of the connector 10 or the tubular member 71 of the counterpart connector 70 which has been brought into the connected state is pulled in a mutually detaching direction (for example, the connector 10 is attached to one end of an electric cable (not shown), and even when the trailing end of the tubular member 20 of the connector 10 is strongly pulled by strongly pulling this cable (not shown)). Incidentally, since the outer sleeve 40 is axially pushed forward by external force which is transferred from the user's fingers or the dedicated jig for a time period taken until the counterpart connector 70 is attached and then its connected state with the connector 10 is established, a facing relation between the block wall 26 on the outside of the tubular member 20 and the leading end surface 47 of the outer sleeve 40 is maintained in a mutually contact state even when the inner sleeve 30 which is disposed within it axially moves back and forth relative to the tubular member 20 as mentioned above.

Next, examples in which operations of releasing lock as mentioned above and detaching the connector 10 from the counterpart connector 70 are performed will be described with reference to FIG. 7 and FIG. 8. The user grips the outer sleeve 40 of the connector 10 with his fingertips or applies the dedicated jig to the outer sleeve 40 to axially move (slides) the outer sleeve 40 backward relative to the tubular member 20. This just corresponds to an operation of pulling the outer sleeve 40 with his fingertips or by the dedicated jig in a detaching direction. When the outer sleeve 40 is moved as mentioned above, the step formed by the small-diameter inner peripheral surface 42 and the large-diameter inner peripheral surface 43 of the outer sleeve 40 comes into engagement with the step formed by the small-diameter outer peripheral surface 32 and the large-diameter outer peripheral surface 33 of the inner sleeve 30 to axially move the inner sleeve 30 backward, so that the operation of pulling the outer sleeve 40 in the detaching direction with the user's fingertips or by the dedicated jig requires the user to exert the external force which is large enough to compress the compression spring 61 via the trailing end surface 36 of the inner sleeve 30 against the elastic force thereof. Then, the inward protruded part 41 of the outer sleeve 40 that has been depressing the engagement ball 11 so far moves backward, and the small-diameter inner peripheral surface 44 of the outer sleeve 40 that has been hiding, facing the second outer-side outer peripheral surface 25 of the receive cylinder part 24, radially appears on the outside of the engagement ball 11 as shown in FIG. 7 in response to the pulling operation mentioned above, by which a space sufficient for the engagement ball 11 to radially move outward is ensured.

When the outer sleeve 40 is further pulled in the detaching direction, the engagement ball 11 which is situated at the position shown in FIG. 7 is pushed by the forward end 23*a* of the ball storage hole 23 and tries to axially move backward as shown in FIG. 5. However, an edge 76 of the engagement recessed part 75 formed in the insert cylinder part 72 of the counterpart connector 70 acts against this movement. A force that axially works in an obliquely forward direction is also radially applied from the edge 76 of the engagement recessed part 75 to the engagement ball 11 outward in this way, and as a result of which the engagement ball 11 radially moves outward within the ball storage hole 23. This position of the engagement ball 11 will be sometimes called a "third position" hereinafter. Then, when the engagement ball 11 is situated at the third position, the part of the engagement ball 11 does not any more protrude inward from the inner peripheral surface 21 of the tubular member 20, and its engagement with the engagement recessed part 75 of the counterpart connector 70 is also released (an unlocked state). The small-diameter inner peripheral surface 44 of the outer sleeve 40 radially appears on the outside of the engagement ball 11, by which the space sufficient for the engagement ball 11 to radially move to the outside is ensured as described above. This is because the radially-directed width (the width from the inner peripheral surface 21 of the tubular member 20, that is, the outer peripheral surface 74 of the insert cylinder part 72 to the small-diameter inner peripheral surface 44 of the outer sleeve 30) of this space is designed to be slightly larger than the diameter of the engagement ball 11.

When the engagement ball 11 is situated at this third position, the part of the engagement ball 11 is in a state that it does not protrude inward from the inner peripheral surface 21 of the tubular member 20 (the unlocked state), so that it becomes possible to pull out the receive cylinder part 24 of the connector 10 from the insert cylinder part 72 of the counterpart connector 70 by further pulling the outer sleeve 40 in the detaching direction. Then, when the insert cylinder part 72 is pulled out and a detached state is established, the outer sleeve 40 and the inner sleeve 30 are pushed forward relative to the tubular member 20 by the elastic force of the compression spring 61. At that time, a depressing force from the inward protruded part 41 of the inner sleeve 30 and a pressing force from the inclined surface 35 of the inner sleeve 30 act on the engagement ball, and the engagement ball 11 which is situated at the third position radially moves inward as shown in FIG. 8. The engagement ball 11 which is situated at this position is held on the forward end 23*a* side of the ball storage hole 23 by the pressing force from the inclined surface 35 of the inner sleeve 30. The position of the engagement ball 11 shown in FIG. 8 is the same as the "thirst position" shown in FIG. 3 with respect to the connector 10. That is, when the connector 10 is detached from the counterpart connector 70, the engagement ball 11 returns to the first position where it is situated before attachment.

Summing up the above, according to the present embodiment, since there can be provided the desired ball locking mechanism with the counterpart connector 70 by basically combining the tubular member 20 in which the ball storage hole 23 is formed, with the inner sleeve 30 and the outer sleeve 40 which are disposed on the outside of the tubular member to be axially movable and are not comparatively complicated in shape, there is such an advantage that the connector 10 which is narrower in diameter size than the prior art can be realized. Such an advantage extremely profitably works in the case that an extremely large number of connectors are to be disposed at a high density on input ports or output ports of various devices (broadcast equipment, AV equipment, signal sending terminals, signal receiving terminals, relays and the like) that transmit signals and electric power using transmission lines. In addition, according to the present invention, since the inner sleeve and the outer sleeve require no complicated manufacturing process, such an advantage is obtained that the connector can be cheaply realized, which greatly contributes to cost reduction when a large number of connectors are to be used.

Although in the above mentioned description of the embodiment, the examples in which the present invention is applied to the electric connector in which the male contact and the female contact that receives it are respectively housed in the tubular member of the connector and the tubular member of the counterpart connector have been described, these are merely examples and the present invention is not limited to them. It goes without saying that the present invention can be applied to optical connectors that include optical transmission members (for example, optical fibers and other light guides) and connectors for applied equipment of fluids such as liquids, gases and the like and for daily necessaries, for example, connectors for air conditioners, connectors for water hydraulic equipment and the like.

INDUSTRIAL APPLICABILITY

The present invention can be widely applied to electric connectors for signal or electric power transmission, optical connectors for optical signal transmission, connectors for fluid applied equipment that transports fluids such as liquids, gases and the like, connectors for daily necessaries and the like.

The invention claimed is:

1. In a connector which is detachably connected to a counterpart connector, the connector comprising:

a tubular member, in which at least one ball storage hole that axially elongates, passing through it from its outer peripheral surface to its inner peripheral surface is formed;

an inner sleeve which is disposed on the outer peripheral surface of said tubular member so as to be axially movable;

an outer sleeve which is disposed on the outside of said inner sleeve so as to be axially movable, the outer sleeve having a protruded part disposed between a first inner peripheral surface and a second peripheral surface; and an engagement ball which is housed in the ball storage hole in said tubular member so as to be axially and radially movable, the engagement ball moving from a first position where at least a part of the engagement ball protrudes inward from the inner peripheral surface of the tubular member by being depressed by the protruded part of the outer sleeve and which is closer to one axially-directed end surface of the ball storage hole, and back to the first position via a second position where a part of the engagement ball does not protrude inward from the inner peripheral surface of the tubular member in the vicinity of the first inner peripheral surface of the outer sleeve and which is closer to the other axially-directed end surface of the ball storage hole when the counterpart connector is to be attached, and moving from the first position and back to the first position via a third position where a part of the engagement ball does not protrude inward from the inner peripheral surface of the tubular member in the vicinity of the second inner peripheral surface of the outer sleeve and which is closer to one axially-directed end surface of the ball storage hole when the counterpart connector is to be detached, wherein when the counterpart connector is attached and connected to the connector, the part of the engagement ball situated at the first position protrudes inward from the inner peripheral surface of the tubular member into engagement with an engagement recessed part which is formed in an outer peripheral surface of the counterpart connector, and the engagement ball is held on the side of one axially-directed end of the ball storage hole by a pressing force from the inner sleeve.

2. The connector according to claim 1, wherein said inner sleeve has a leading end side inclined surface that comes into contact with the engagement ball when the counterpart connector is attached, and a trailing end surface that receives a pressing force from a compression spring which is disposed on the outer peripheral surface of the tubular member.

3. The connector according to claim 2, wherein said inner sleeve has a first small-diameter outer peripheral surface situated on the leading end side, and a second large-diameter outer peripheral surface situated on the trailing end side, and said outer sleeve further has a third large-diameter inner peripheral surface which is adjacent to the first small-diameter inner peripheral surface of the outer sleeve, wherein the first small-diameter outer peripheral surface and the second large-diameter outer peripheral surface of the inner sleeve respectively correspond to the first small-diameter inner peripheral surface and the second large-diameter inner peripheral surface of the outer sleeve, and wherein when an insert cylinder part of the counterpart connector is attached to the tubular member, the inner sleeve moves in a direction in which the compression spring is compressed relative to the tubular member and the outer sleeve, and when the insert cylinder part of the counterpart connector is detached from the tubular member, the outer sleeve and the inner sleeve move together in the direction in which the compression spring is compressed relative to the tubular member.

* * * * *